US006431546B1

(12) United States Patent
Keller

(10) Patent No.: US 6,431,546 B1
(45) Date of Patent: Aug. 13, 2002

(54) APPARATUS AND METHOD OF PLAYING A CASINO-TYPE DICE GAME

(76) Inventor: Renee M. Keller, 245 Raymond Dr., Hubbard, OH (US) 44425

( * ) Notice: Subject to any disclaimer, the term of this patent is extended or adjusted under 35 U.S.C. 154(b) by 0 days.

(21) Appl. No.: 09/711,309

(22) Filed: Nov. 14, 2000

(51) Int. Cl.[7] ..... A63F 9/04
(52) U.S. Cl. ..... 273/274; 273/146
(58) Field of Search ..... 273/274, 146, 273/309

(56) References Cited

U.S. PATENT DOCUMENTS

| | | | | |
|---|---|---|---|---|
| D180,186 | S | * | 4/1957 | Grobauer |
| 3,399,897 | A | * | 9/1968 | Mitchell |
| 3,463,496 | A | | 8/1969 | Weinstein et al. |
| 3,904,208 | A | * | 9/1975 | Grossman |
| 4,043,560 | A | | 8/1977 | Blackman |
| 4,247,114 | A | * | 1/1981 | Carroll |
| 4,312,508 | A | | 1/1982 | Wood |
| 4,346,900 | A | | 8/1982 | Lamlee |
| 5,308,081 | A | * | 5/1994 | Bartle |
| 5,350,175 | A | * | 9/1994 | DiLullo et al. |
| 5,695,193 | A | * | 12/1997 | Cheung |
| 5,791,651 | A | | 8/1998 | Bryant |
| 5,879,006 | A | | 3/1999 | Bowling |
| 6,176,489 | B1 | * | 1/2001 | Astaneha |
| 6,209,874 | B1 | * | 4/2001 | Jones |

* cited by examiner

*Primary Examiner*—Benjamin H. Layno
(74) *Attorney, Agent, or Firm*—Bacon & Thomas, PLLC

(57) ABSTRACT

A casino-type dice game employing at least two dice having identical indicia on each of the six faces. The game is provided with three different betting areas each associated with a different payoff rate and wager minimum. Each betting area has a different indicia combination scheme. Players selectively place wagers next to different indicia combinations associated with each of the three betting areas. Payouts depend on the rolled indicia combinations, the betting areas, and the indicia combination selected by the player.

6 Claims, 1 Drawing Sheet

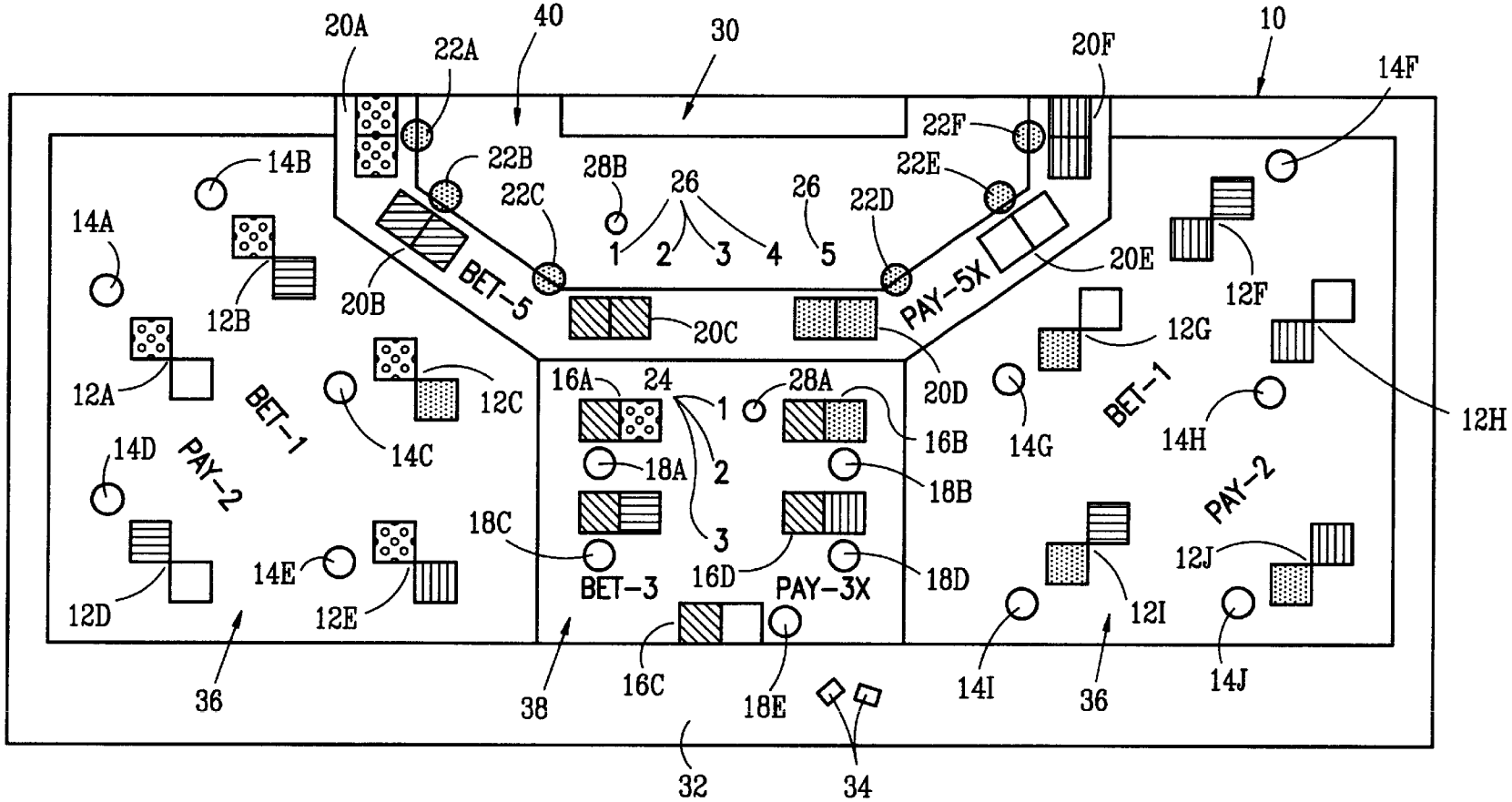
10
12H
14F
12F
14H
PAY-2
12J
14J
12G
BET-1
20E
20F
12I
36
14G
14I
22F
22E
PAY-5X
20D
16B
18B
18D
22D
34
26
5
28A
PAY-3X
18E
30
4
3
26
2
1
20C
24
1
2
3
16D
32
28B
18A
16C
16A
BET-3
40
22C
38
22B
BET-5
12C
18C
22A
14C
20B
12E
20A
14B
BET-1
14E
12B
PAY-2
36
14D
14A
12A
12D

APPARATUS AND METHOD OF PLAYING A CASINO-TYPE DICE GAME

BACKGROUND OF THE INVENTION

1. Field of Invention

A casino-type game of chance utilizing dice a game board, betting pieces and dice.

2. Prior Art

There are various existing casino-type dice games. Such games often require players to select various outcomes of dice rolls by placing bets in designated areas. Although simple in nature, many of the dice games, such as craps, have complex rules and tend to attract only experienced gamblers. Therefore, there has been a need for casino-type dice games with simple rules that cater to less experienced gamblers.

SUMMARY OF THE INVENTION

This invention relates to a casino-type dice game. Preferably, the game utilizes two six-sided dice with color-coded indicia arranged on the faces of each dice cube so that each face has a different color. Other indicia may be used that permit each face of the cube to be distinguished from one another. Thus, the theme of the game is open to utilizing different indicia such as numbers, animals, sporting or business themes.

The present game is a game of chance. This is accomplished by dividing the game into three betting areas associated with different indicia combinations. Although the odds to select the correct combination are the same for all three betting areas, the stakes are modified to represent a different payout for each betting area. In addition, each betting area represents a different duration for the period a wager may remain without being lost.

The present invention involves a plurality of players and is played with at least two dice and a game board. Three betting areas are provided and each is associated with different indicia combinations that can exist when the dice are rolled. In addition, rewards are set for each betting area based on indicia combinations located therein.

The game is played by the players placing wagers next to different indicia combinations located in at least one of the three betting areas. The dice is rolled over a sequence of times. The players are rewarded after each dice roll in an amount associated with a respective betting area.

The three betting areas are distinguished as follows. In the first betting area, a first set of wagering spots represent different indicia combinations that correspond to five dice surfaces wherein each of said indicia combinations located in the first set of wagering spots comprise different indicia. In the second betting area, there is a second set of wagering spots representing different indicia combinations that correspond to a sixth dice surface matched with one of the five dice surfaces corresponding to the first set of wagering spots. Finally in the third betting area, there is a third set of wagering spots representing indicia combinations that have the same indicia.

Additional features of this invention will become apparent from the ensuing descriptions of this invention.

BRIEF DESCRIPTION OF THE FIGURE

The FIGURE illustrates a preferred embodiment of this game when applied to a casino-type dice game.

DESCRIPTION OF THE INVENTION

Referring to the FIGURE, there is shown a dice game with two identical cube dice 34 each having six sides with indicia uniquely identifying each of the faces. In a preferred embodiment each of the surfaces is color coded to denote a different surface. While the color coded surfaces are preferred, it will be understood that variations of coding the surfaces may be employed. Thus, indicia that denotes each of the six surfaces may be numbers, animals or business themes. Furthermore, the dice game may be played with more than two dice.

Each player already has or is provided with value units or betting pieces such as betting chips. The players select certain color combinations of the dice based on the probability that certain combinations will be rolled. Wagers are made by the players against the house.

In a preferred embodiment layout 10, the game is provided with three betting areas for a variety of wagers associated with different dice color combinations. In the particular layout 10, a first betting area 36 is arranged with images of ten dice combinations 12A–12J wherein each combination comprises two different colors. The ten dice combinations consist of a same set of five colors for each die. Next to each of the first betting area combinations 12A–12J, a placement spot 14A–14J is furnished for the player's chips. The first betting area 36 is provided with a description of the type of wager and the payoff, wherein the minimum bet is one chip and the payoff is one chip for each rolled color of the selected color combination such that the maximum payoff is two chips for each color of a combination. Further, new wagers can be placed after each dice roll.

The second betting area 38 is arranged with images of five dice combinations 16A–16E. The five dice combinations comprise combinations of each of the five colors of the five color set in the first betting area with a sixth color. Next to each of the five dice combinations 16A–16E a placement spot 18A–18E is furnished for the player's wagers. The second betting area 38 is provided with a description of the type of wager and the payoff, wherein the minimum bet is three chips and the payoff is three times the amount of the wagered chips. New wagers can be placed after three dice rolls.

The third betting area 40 is arranged with images of six dice combinations 20A–20F. The six dice combinations 20A–20F comprise dice combinations wherein each die has the same color as the other. Next to each of the six combinations 20A–20F a placement spot 22A–22F is furnished for the player's wagers. The third betting area 40 is provided with a description of the type of wager and the payoff, wherein the minimum bet is five chips and the payoff is five times the amount of wagered chips. New wagers are placed after five dice rolls.

Within the second betting area 38 and the third betting area 40 are roll numbers 24,26 representing the number of rolls. Markers 28A–28B are provided for the dealer to place next to the roll numbers 24, 26 after each roll.

To begin the game, the players place their chips on color combinations 12A–12J, 16A–16E, and 20A–20F. Before each dice roll, the dealer places the markers 28A–28B next to the roll numbers 24,26 corresponding to the roll. The dice is rolled. If the dice roll has one of the colors in a players' selected color combination in a first betting area 36, the player is payed equal the amount the player has wagered for each color selected in the color combination. If no colors appear on the dice in the selected combination, the player loses the wager. Wagers placed in the second betting area 38 and the third betting area 40 do not count in the single color payoffs.

Players having placed bets in the second betting area 38 continue to play with the wagers made before a first dice roll.

The wagers placed in the second betting area 38 remain for three rolls. If a player wins after a first, second or third roll, the dealer pays the player three times the amount wagered. The player has the option to remove all chips after winning before the next roll. After three dice rolls, the dealer will collect all chips from the second betting area 38.

Players having placed wagers in the third betting area 40 continue to play with the bets made before the first dice roll. The bets placed in the third area 40 remain for five dice rolls. If a player wins after the first, second, third, fourth or fifth roll, the dealer pays the player five times the amount wagered. The player has the option to remove all wagers after winning before the next roll. After five dice rolls, the dealer will collect all remaining wagers from the third betting area 40.

Having thus described the invention, changes and modifications may be made within this invention as will be apparent to those skilled in the art. Such modifications are intended to be within the scope of the invention as defined in the appended claims.

I claim:

1. A method for playing a dice game involving a plurality of players, the method comprising the steps of:

providing at least two identical dice each having six surfaces with indicia thereon uniquely identifying each of the faces;

establishing three betting areas associated with different indicia combinations that can exist when said dice are rolled;

setting rewards for each betting area based on indicia combinations located therein;

said players placing wagers next to different indicia combinations located in at least one of said three betting areas;

rolling the dice over a sequence of times;

rewarding the players after each dice roll in an amount associated with a first betting area for each indicia of each selected indicia combination located in the first betting area represented by said rolled dice;

removing all remaining wagers located in said first betting area not associated with an indicia of the rolled dice wherein wagers are placed next to a combination in said first betting area before each dice roll;

rewarding the players in an amount associated with a second betting area for the selected indicia combination located in the second betting area represented by said rolled dice;

keeping wagers not associated with a rolled indicia combination placed in said second betting area for three dice rolls wherein all remaining wagers located in said second betting area after a third dice roll are lost;

rewarding the players in an amount associated with a third betting area for the selected indicia combination located in the third betting area represented by said rolled dice;

keeping wagers not associated with a rolled indicia combination placed in said third betting area for five dice rolls wherein all remaining wagers located in said third betting area after a fifth dice roll are lost;

allowing the players to remove a wager associated with a rolled indicia combination corresponding to a selected indicia combination located in the second or the third betting area after being rewarded.

2. A method for playing a dice game as in claim 1 further comprising the step indicating the number of dice rolls using a roll marker.

3. A method for playing a dice game as in claim 1 further comprising the step of identifying each face of said dice with a different color, each dice being identically color coded.

4. A dice board game for at least two players, the dice board game comprising:

a game board having a playing surface;

at least two dice, each of said dice having six surfaces with indicia thereon uniquely identifying each of the faces;

a plurality of first betting areas on said playing surface, each of said first betting areas having a first set of wagering spots representing different indicia combinations corresponding to five dice surfaces wherein each of said indicia combinations located in the first set of wagering spots comprise different indicia;

a second betting area on said playing surface, said second betting area having a second set of wagering spots representing different indicia combinations each corresponding to a sixth dice surface matched with one of the five dice surfaces corresponding to the first set of wagering spots; and a third betting area on said playing surface, said third betting area having a third set of wagering spots representing indicia combinations having the same indicia.

5. A dice board game as claimed in claim 4 wherein each face of said dice is identified by each dice being identically color coded.

6. A dice board game as claimed in claim 4 further comprising a roll indication area wherein a marker indicating the number of dice rolls may be placed.

* * * * *